US009744655B2

(12) United States Patent
Trimpe et al.

(10) Patent No.: US 9,744,655 B2
(45) Date of Patent: Aug. 29, 2017

(54) HOSE TOOL

(71) Applicant: Hose Tool, LLC, Alva, OK (US)

(72) Inventors: Gary Lewis Trimpe, Preston, KS (US); Kyle James Eckhardt, Enid, OK (US)

(73) Assignee: Hose Tool, LLC, Alva, OK (US)

( * ) Notice: Subject to any disclaimer, the term of this patent is extended or adjusted under 35 U.S.C. 154(b) by 0 days.

(21) Appl. No.: 15/068,296

(22) Filed: Mar. 11, 2016

(65) Prior Publication Data

US 2016/0263734 A1 Sep. 15, 2016

Related U.S. Application Data

(60) Provisional application No. 62/132,593, filed on Mar. 13, 2015.

(51) Int. Cl.
*B25B 27/10* (2006.01)

(52) U.S. Cl.
CPC ..... *B25B 27/10* (2013.01)

(58) Field of Classification Search
CPC . B25B 27/10; B25B 27/16; F16L 1/09; B21D 39/046; B21D 39/04
USPC ..... 29/237, 239, 270; 269/3, 6, 902, 269/165–171.5
See application file for complete search history.

(56) References Cited

U.S. PATENT DOCUMENTS 2,916,812 A * 12/1959 Milo ..... B25B 27/10 29/237
4,170,125 A * 10/1979 Minka ..... B25B 27/02 29/237
4,598,452 A * 7/1986 Iseki ..... B25B 27/02 29/237
4,757,588 A 7/1988 Churchich
5,068,953 A * 12/1991 Semotiuk ..... B25B 27/10 29/235
5,233,739 A * 8/1993 Holden ..... B23P 11/005 138/121
5,513,425 A * 5/1996 Williams ..... B25B 27/10 29/237
5,537,727 A * 7/1996 Mayer ..... B25B 27/10 29/237
5,566,438 A * 10/1996 Bullock ..... B25B 7/02 29/237
5,802,690 A * 9/1998 Bullock ..... B25B 7/02 29/237

(Continued)

OTHER PUBLICATIONS

International search report for PCT/US2016/022099.

*Primary Examiner* — George Nguyen
(74) *Attorney, Agent, or Firm* — Martin S. High, P.C.

(57) ABSTRACT

Embodiments of the Hose Tool are comprised of head assembly and handle assembly. The head assembly is comprised of a hose tab guide, a plurality of hose dogs, a plunger bar rack, and a hose tab guide sleeve. The handle assembly is comprised of a chassis, plunger bar rack, two handle pinons, a spring, two hinged handles, two bolts, a pivot pin, a guide bolt, two latch pins, and latch pin spring. The two hinged handles are attached to the two handle pinons via two bolts; held open by two latch pins being pressed into slot in two handles pinons by a latch pin spring. Depressing the two latch pins allows two hinged handles to swing alongside hose tool for storage. The two halves of two handle pinons are separated, timed and engaged within the plunger bar rack; then inserted into chassis and secured with pivot pin.

2 Claims, 5 Drawing Sheets

(56) References Cited

U.S. PATENT DOCUMENTS

| | | | | |
|---|---|---|---|---|
| 5,979,032 | A | 11/1999 | Roy | |
| 6,658,711 | B1 * | 12/2003 | Benson | B25B 5/068 269/3 |
| 7,322,085 | B1 * | 1/2008 | Benson | B25B 27/10 269/3 |
| 8,615,863 | B1 * | 12/2013 | Hope | B25B 27/10 29/255 |
| 2013/0047389 | A1 | 2/2013 | Eldar | |

* cited by examiner

HOSE TOOL

BACKGROUND OF THE EMBODIMENTS

Field of the Embodiments

The general field of the embodiments of the Hose Tool is mechanical connections and use of hoses of various diameters. More specifically, the Hose Tool is used to make connections between hoses and hose fittings.

Description of Prior Art

When a hose fitting such as a coupling or other type of fitting is to be inserted into a hose, the user has typically resorted to physical strength to work a fitting into the hose. The fitting and hose are essentially the same diameter, and inserting a fitting into a hose end is always difficult to engage into the hose.

SUMMARY OF THE EMBODIMENTS

Embodiments of the Hose Tool are comprised of head assembly and handle assembly. The head assembly is comprised of a hose tab guide, a plurality of hose dogs, a plunger bar rack, and a hose tab guide sleeve. The handle assembly is comprised of a chassis, plunger bar rack, two handle pinons, a spring, two hinged handles, two bolts, a pivot pin, a guide bolt, two latch pins, and latch pin spring. The two hinged handles are attached to the two handle pinons via two bolts; held open by two latch pins being pressed into slot in two handles pinons by a latch pin spring. Depressing the two latch pins allows two hinged handles to swing alongside hose tool for storage. The two halves of two handle pinons are separated, timed and engaged within the plunger bar rack; then inserted into chassis and secured with pivot pin.

There has thus been outlined, rather broadly, the more important features of the embodiments of the Hose Tool in order that the detailed description thereof that follows may be better understood, and in order that the present contribution to the art may be better appreciated. There are, of course, additional features of the embodiments that will be described hereinafter and which will form the subject matter of the claims appended hereto.

In this respect, before explaining at least one embodiment of the embodiments in detail, it is to be understood that the embodiment is not limited in this application to the details of construction and to the arrangements of the components set forth in the following description or illustrated in the drawings. The embodiment or embodiments are capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be used as a basis for the designing of other structures, methods and systems for carrying out the several purposes of the embodiments. Additional benefits and advantages of the embodiments will become apparent in those skilled in the art to which the present embodiments relates from the subsequent description of the preferred embodiment and the appended claims, taken in conjunction with the accompanying drawings. It is important, therefore, that the claims be regarded as including such equivalent constructions insofar as they do not depart from the spirit and scope of the embodiments.

Further, the purpose of the foregoing abstract is to enable relevant patent granting authorities and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application which is measured by the claims, nor is it intended to be limiting as to the scope of the embodiments in any way.

DETAILED DESCRIPTION OF THE PREFERRED EMBODIMENTS

Figure 1:
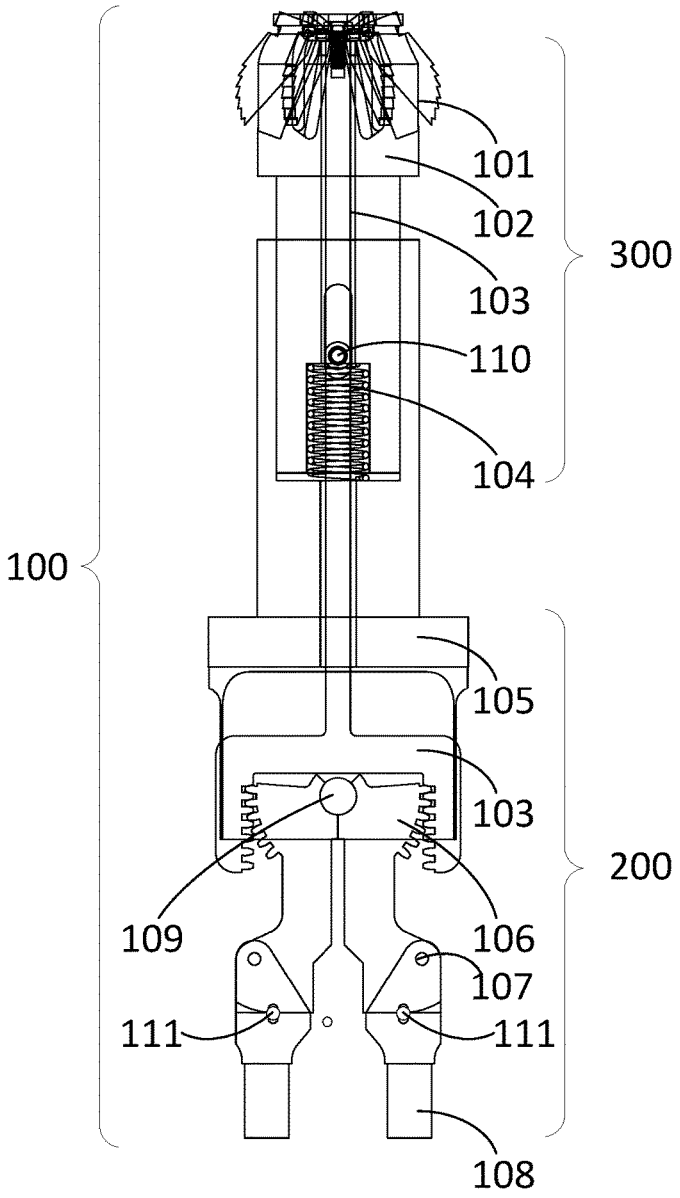
FIG. 1A is a front view of an embodiment of the Hose tool.
Figure 2:
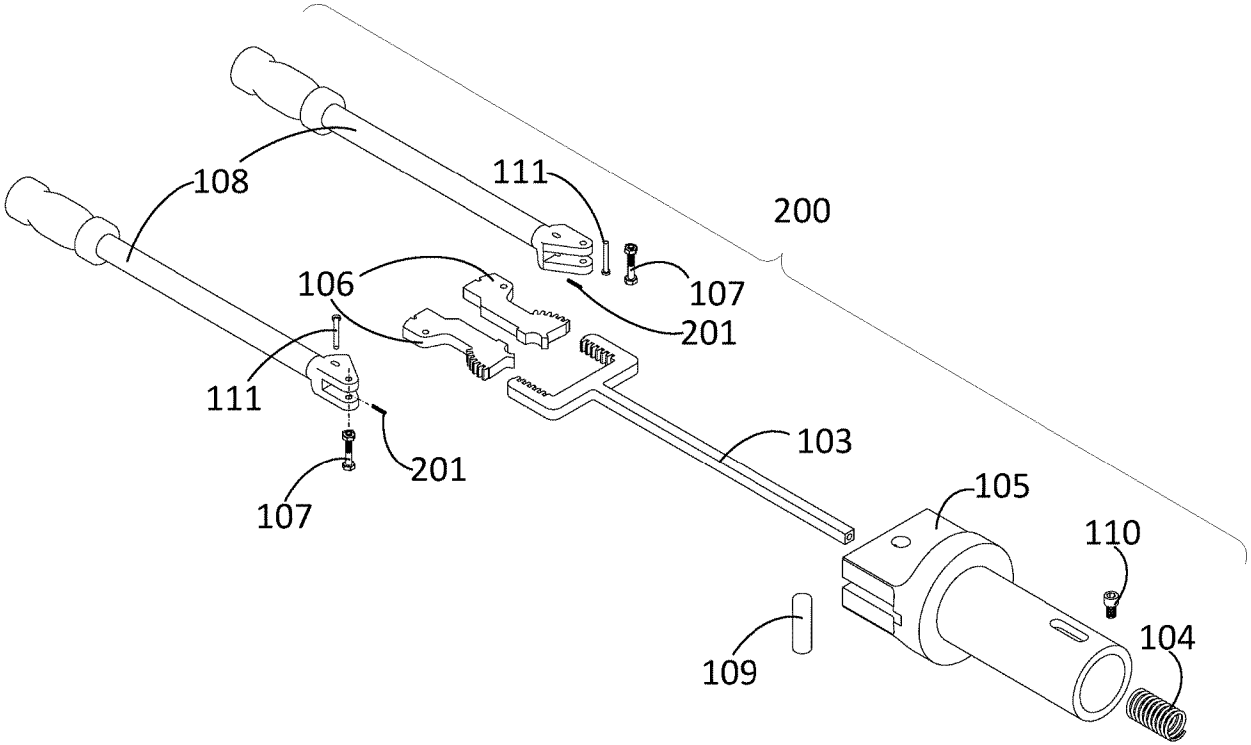
FIG. 2 is an exploded view of the handle assembly of an embodiment of the Hose Tool
Figures 3A, 3B:
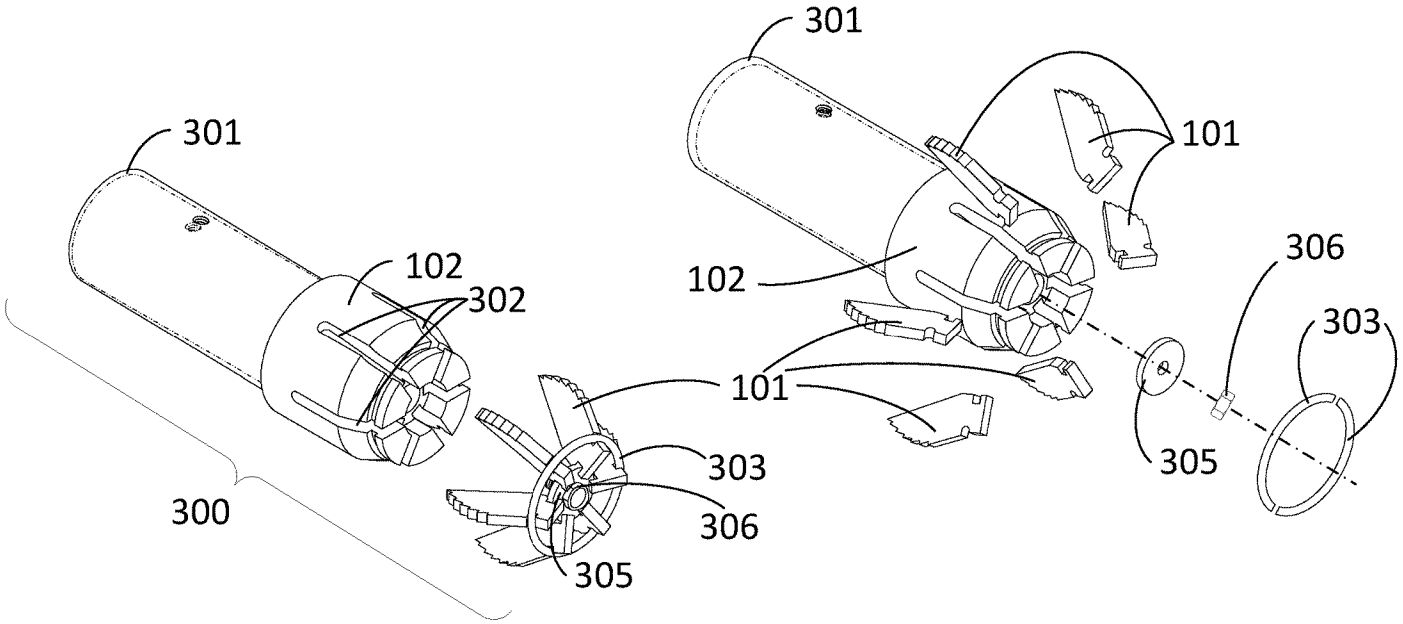
FIG. 3A is a perspective view of a partially exploded view of the head assembly of an embodiment of the Hose Tool.
FIG. 3B is an exploded view of the head portion of an embodiment of the Hose Tool.
Figures 4A, 4B:
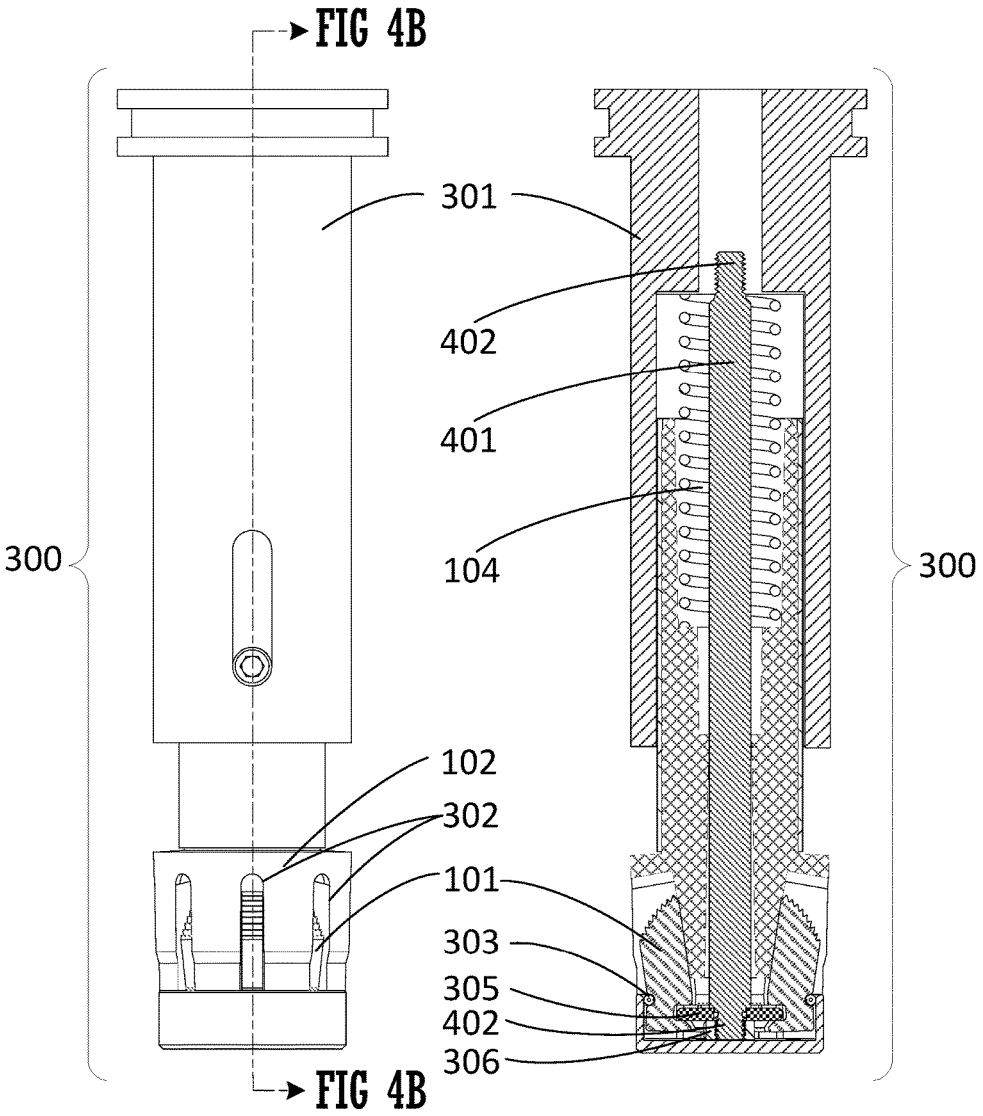
FIG. 4A is a front view of the head portion of an embodiment of the Hose Tool.
FIG. 4B is a sectional view of the head portion of an embodiment of the Hose Tool.
Figures 5A, 5B:
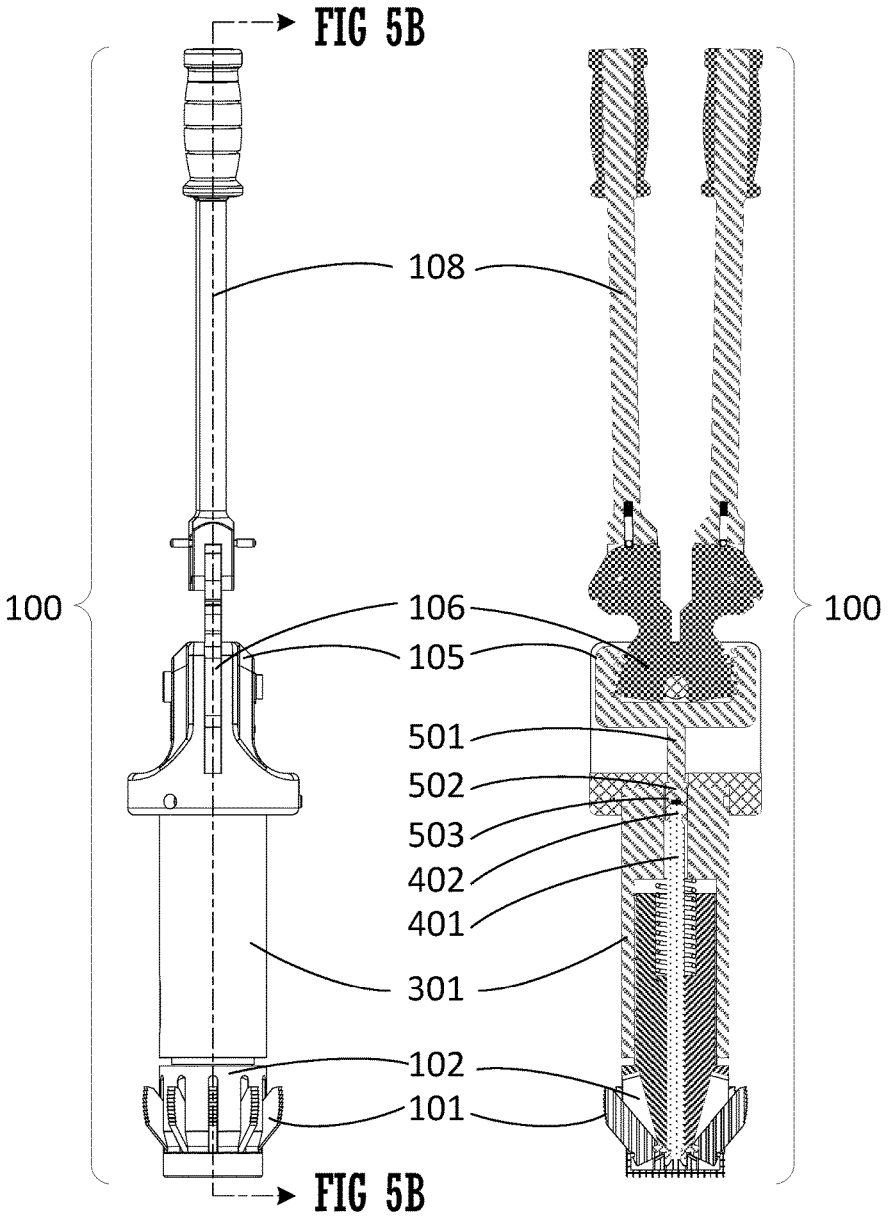
FIG. 5A is a front view of an assembled embodiment of the Hose Tool.
FIG. 5B is a sectional view of an assembled embodiment of the Hose Tool.

Embodiments of the Hose Tool 100 are comprised of head assembly 300 and handle assembly 200.

The head assembly is comprised of a hose tab guide 102, a plurality of hose dogs 101, a plunger bar rack 103, and a hose tab guide sleeve 301.

The hose tab guide 102 forms a plurality of slots 302 around the periphery and tip of the hose tab guide 102. The hose dogs 101 are placed around the tip and periphery of the hose tab guide 102 and are inserted into the slots 302 in the hose tab guide 102. The hose dogs 101 are secured to the hose tab guide 102 via a split retention ring 303 that is set into the outer recess in hose dogs 101 and the groove in hose tab guide 102 forming a pivot point. Washer 305 is set into the inner recess in hose dogs 101 and nut 306 attaches to plunger bar rack 103 forming the parameters around which the hose dogs 101 are rotated in and out. A nut 306 and a washer 305 is inserted through the end of the hose tab guide 102.

The handle assembly is comprised of a chassis 105, plunger bar rack 103, two handle pinons 106, a spring 104, two hinged handles 108, two bolts 107, pivot pin 109, guide bolt 110, two latch pins 111, and latch pin spring 201. The two hinged handles 108 are attached to the two handle pinons 106 via two bolts 107 held open by two latch pins 111 being pressed into slot in two handle pinions 106 by latch pin spring 201. When depressing two latch pins 111 allows two hinged handles 108 to swing alongside hose tool 100 for storage. The two halves of two handle pinons 106 are separated, timed and engaged within the plunger bar rack 103 then inserted into chassis 105 and secured with a pivot pin 109. The two latch pins 111 are held in place with press washers. The pivot pin 109 is held in place with snap rings.

The head assembly 300 is engaged with the handle assembly 200 by inserting the head assembly 300 within the chassis 105 and securing the assembly with a guide bolt 110. In addition, the head assembly 300 is secured with a nut 306 and a washer 305 to the end of the plunger bar rack 103. Guide bolt 110 is positioned within a slot in chassis 105 and threaded in hose tab guide 102 to stop spring 104 from fully opening the two hinged handles 108. This allows for the last 10 degrees of opening travel to drive the plunger bar rack 103 into the hose tab guide 102 via washer 305 to retract plurality of hose dogs 101 into slots 302 in hose tab guide 102. This allows hose tool 100 to be retracted from hose and fittings. The spring 104 supplies the tension needed to move plurality of hose dogs 101 in an outward direction during the pulling process.

The head assembly 300 forms the portion of the hose tool 100 that is inserted in the hose to be operated on. First, the hose fitting is inserted over the head assembly 300. With the hinged handles 108 expanded, the edge of the hose fitting is inserted in the proximal end of the hose as far as possible. Then the hinged handles 108 are collapsed to engage the hose dogs 101 and to draw the fitting into the hose. The hinged handles 108 are then expanded to disengage the hose dogs 101. The hose tool is inserted a little farther. The hinged handles 108 are then collapsed to reengage the hose dogs 101 onto the inside of the hose and draw the hose fitting further into the hose. The repeated expansion and collapse of the hinged handles draws the fitting into the hose and eventually engages the fitting fully into the hose.

In another embodiment, the head assembly 300 is removable from the handle assembly 200. In this embodiment, the plunger bar rack is replaced with a head assembly plunger bar 401 and a handle assembly plunger bar 501. Each end of the head assembly plunger bar 401 terminates with a head assembly plunger bar threaded connection 402. The handle assembly plunger bar 501 terminates with handle assembly plunger bar threaded connection 502. The two plunger bars are joined together with a threaded coupling 503. The handle assembly plunger bar threaded connection 502 is affixed to the threaded coupling 503 with thread locking compound. The head assembly 300 is disconnected from the handle assembly 200 by turning the handle assembly 200 relative to the head assembly 300 thereby turning the head assembly plunger bar threaded connection 402 relative to the threaded coupling 503 eventually disconnecting the two. Installing a new head assembly 300 is performed in the reverse manner.

What we claimed is:

1. A hose tool (100) comprised of a head assembly (300) and a handle assembly (200);

wherein the head assembly is comprised of a hose tab guide (102), a plurality of hose dogs (101), a hose tab guide sleeve (301), a washer (305), a nut (306), and a split retention ring (303);

and wherein the handle assembly is comprised of a chassis (105), a plunger bar rack (103), a handle pinon (106), a spring (104), two hinged handles (108), two bolts (107), two latch pin springs (201), a pivot pin (109), two latch pins (111), and a guide bolt (110).

2. The hose tool described in claim 1 wherein the plunger bar rack is comprised of a head assembly plunger bar (401) and a handle assembly plunger bar (501);

wherein the head assembly plunger bar (401) terminates with a head assembly plunger bar threaded connection (402), and the handle assembly plunger bar (501) terminates with handle assembly plunger bar threaded connection (502);

wherein the two plunger bars are joined together with a threaded coupling (503), the head assembly plunger bar threaded connection (402) is affixed to the threaded coupling (503) with thread locking compound.

* * * * *